US012274408B2

(12) United States Patent
Gambrel et al.

(10) Patent No.: US 12,274,408 B2
(45) Date of Patent: Apr. 15, 2025

(54) WAREWASHING MACHINE WITH DRAIN WATER TEMPERING SYSTEM

(71) Applicant: Jackson WWS, Inc., Barbourville, KY (US)

(72) Inventors: Brian Gambrel, Corbin, KY (US); Paul Wells, Corbin, KY (US)

(73) Assignee: Jackson WWS, Inc., Barbourville, KY (US)

( * ) Notice: Subject to any disclaimer, the term of this patent is extended or adjusted under 35 U.S.C. 154(b) by 323 days.

(21) Appl. No.: 17/581,102

(22) Filed: Jan. 21, 2022

(65) Prior Publication Data

US 2023/0233051 A1 Jul. 27, 2023

(51) Int. Cl.
*A47L 15/42* (2006.01)

(52) U.S. Cl.
CPC ..... *A47L 15/4217* (2013.01); *A47L 15/4274* (2013.01)

(58) Field of Classification Search
None
See application file for complete search history.

(56) References Cited

U.S. PATENT DOCUMENTS 2,296,055 A * 9/1942 Ray ..... B01F 21/22 222/416
3,878,856 A * 4/1975 Hall ..... A47L 15/243 134/80
5,462,606 A * 10/1995 Burns ..... A47L 15/0015 222/54
2009/0194562 A1* 8/2009 Kessler ..... E03D 9/03 222/63

(Continued)

FOREIGN PATENT DOCUMENTS

EP 1723887 A2 * 11/2006 ..... A47L 15/0005
KR 100505153 B1 * 8/2005

(Continued)

OTHER PUBLICATIONS

Jackson Warewashing Systems, Drain Water Tempering Install Door Units, Sep. 4, 2020, (Year: 2020).*

(Continued)

*Primary Examiner* — Omair Chaudhri
(74) *Attorney, Agent, or Firm* — Nelson Mullins Riley & Scarborough LLP

(57) ABSTRACT

A warewashing machine including a housing defining an internal volume, a heat source for heating the water from a first water source, a hot water tank for receiving water heated by the heat source, an agitation unit for applying water to the dishware, and a drain water tempering system having a drain water fitting defining an interior chamber, a drain water inlet port, a drain water outlet port, a cool water inlet port, and a drain tempering valve disposed within the cool water inlet port and movable between a closed position blocking a fluid flow path between the interior chamber and an open position opening the flow path, the drain tempering valve including a temperature sensor, wherein the interior chamber defines a top volume portion, and a bottom volume portion, disposed below a threshold at which the drain water outlet port intersects the interior chamber of the body.

17 Claims, 7 Drawing Sheets

(56) References Cited

U.S. PATENT DOCUMENTS

| | | | | |
|---|---|---|---|---|
| 2009/0241993 | A1* | 10/2009 | Warner | A47L 15/241 134/10 |
| 2010/0059086 | A1* | 3/2010 | Brunswick | A47L 15/241 134/10 |
| 2011/0048465 | A1* | 3/2011 | Jerg | A47L 15/0023 134/25.2 |
| 2011/0126861 | A1* | 6/2011 | Dorigo | A47L 15/0057 134/104.1 |
| 2012/0125373 | A1* | 5/2012 | Grull | A47L 15/4217 134/94.1 |

FOREIGN PATENT DOCUMENTS

| | | | | |
|---|---|---|---|---|
| KR | 200426632 | Y1 * | 9/2006 | |
| KR | 20090038504 | A * | 4/2009 | |
| KR | 101214726 | B1 * | 12/2012 | |
| WO | WO-2004023967 | A1 * | 3/2004 | A47L 15/0089 |

OTHER PUBLICATIONS

Circuitsolver, Drain Tempering Valve (DTV), Mar. 29, 2018 (Year: 2018).*

* cited by examiner

WAREWASHING MACHINE WITH DRAIN WATER TEMPERING SYSTEM

FIELD OF THE INVENTION

The present invention relates generally to warewashing machines. More particularly, the present invention relates to warewashing machines including systems for tempering water that is drained from warewashing machines after dishware cleaning operations.

BACKGROUND OF THE INVENTION

Warewashing machines perform cleaning and sanitizing cycles on dishware that may utilize water at high temperatures, e.g. up to 180° F. Regulations exist that put an upper limit of 140° F./60° C. on the temperature of wastewater that may be discharged into a building's drainage system. For example, Chapter 7, Section 701.7 of the 2018 International Plumbing Code provides that "wastewater when discharged into the building drainage system shall be at a temperature not higher than 140° F. (60° C.). When higher temperatures exist, approved cooling methods shall be provided." Regulations dictate this upper limit on wastewater drainage because, when drained, wastewater initially flows down into traps provided in the building's drainage piping that are intended, among other things, to trap grease and prevent the grease from flowing down further into the drainage system, where it may solidify and cause blockages. If wastewater exceeding the defined limit is allowed to drain, and thus enter the traps, the wastewater can melt or dislodge the previously solidified grease from the traps, allowing the grease to flow downstream within the drainage system where it can re-solidify, possibly causing a blockage at a point that is not readily accessible. As well, various components, such as, but not limited to, piping, fittings, gaskets, etc., may be formed of materials, such as, but not limited to, polyvinylchloride (PVC), nylon, etc., that may be damaged by excessive heat. One of the approved cooling methods is the use of a drain water tempering system, as shown in FIGS. 1A and 1B, to mix cold water with the hot wastewater as it drains from the warewashing machine.

FIGS. 1A and 1B provide a partial view of a warewashing machine 10 including an interior volume 12 in which dishwares 69 (FIG. 6) to be cleaned are disposed, a hot water tank 16 that stores a volume of water 19 that is recirculated within the interior volume 12 by a recirculation pump 18 during cleaning and sterilization operations, and a drain water tempering system 20 that connects the hot water tank 16 to the drainage system (not shown) of a building. Referring additionally to FIGS. 2A and 2B, a known drain water tempering system 20 includes a drain water fitting 22 and a drain tempering valve 24. Drain water fitting 22 includes a substantially cylindrical body 21 defining an interior chamber 23, a drain water inlet port 25 in fluid communication with a drain 17 on the bottom wall of hot water tank 16, a cold water inlet port 27 that is in fluid communication with a cold water source (not shown) of the building as well as interior chamber 23 of drain water fitting 22, and a drain water outlet port 29 that is in fluid communication with the drain system of the building.

Referring specifically to FIG. 1A, in operation, a standpipe 30 has an open bottom end 32 that is seated within drain 17 of hot water tank 16 so that hot water accumulates within the hot water tank 16 until the level of hot water 19 reaches an open top end 34 of the standpipe 30. Preferably, the volume of hot water 19 within hot water tank 16 is utilized for multiple cleaning cycles of multiple sets of dishware, for example, up to six to eight cleaning cycles, before the hot water is drained. As shown in FIGS. 1B and 2B, the used wastewater is drained from hot water tank 16 by moving standpipe 30 in an upward direction, such as by a lever or handle (not shown), thereby unseating open bottom end 32 of standpipe 30 from drain 17 of hot water tank 16. As such, the wastewater disposed within hot water tank 16 is now free to drain into interior chamber 23 of drain water fitting 22.

Drain tempering valve 24 includes a temperature sensor 26 that extends inwardly into interior chamber 23 of the drain water fitting. Drain tempering valve 24 may be a mechanical valve including a bimetallic switch (not shown). The set point of the drain tempering valve's bimetallic switch is adjusted to desired threshold temperature, such as 160° F., so that when temperature sensor 26 is immersed in large amounts of draining wastewater (indicated by arrow 13) that exceeds the set point, such as when a bottom end 32 of standpipe 30 is withdrawn from drain 17 of hot water tank 16, as shown in FIGS. 1B and 2B, the bimetallic switch changes state, thereby causing drain tempering valve 24 to open so that cold water from the cold water source flows into interior chamber 23 of drain water fitting 22. This mixes the cold water with the draining wastewater prior to the wastewater exiting drain water outlet port 29, thereby lowering the temperature of the water exiting outlet port 29. As long as the temperature of the wastewater within interior chamber 23 of drain water fitting 22 exceeds the valve's set point, the bimetallic switch will maintain drain tempering valve 24 in its open position. Once the temperature of the wastewater with interior chamber 23 no longer exceeds the set point, the bimetallic switch changes state, thereby closing the drain tempering valve 24 and securing the flow of cold water into the drain water fitting 22. Electronic drain tempering valves may also be used in drain water tempering systems. In general, the drain tempering valve comprises a valve body that defines an inlet port and an outlet port. In this instance, the inlet port is connected to the cold water source, while the outlet port is connected to interior chamber 23. The valve body defines a valve seat at an opening between the inlet and outlet ports that fluidly connects the ports. A valve plug is disposed movably within the valve body between two states, one (closed) in which the valve plug engages the valve seat and thereby blocks fluid flow from the inlet to the outlet port, and one (open) in which the valve plug is offset from the valve seat, thereby allowing fluid flow from the inlet port to the outlet port. A biasing device, e.g. a spring or solenoid, is disposed operatingly between the valve plug and the valve body, normally maintaining the valve plug in either the open or closed position. In the embodiments discussed herein, biasing device biases the valve plug so that the valve is normally (i.e. when the thermostatic element discussed below, is not in contact with fluid above the set point temperature) closed. A thermostatic actuator, e.g. a bimetallic or fluid or wax-controlled switch, is disposed operatively between the biasing device and the valve plug and is disposed operatingly within interior chamber 23 so that, when fluid within interior chamber 23 contains fluid above the set point temperature, the thermostatic actuator, in contact with the fluid, changes states, thereby causing the biasing device to change the valve plug's state. In one or more embodiments, e.g. a compressed spring may normally bias the valve plug to the closed state, but when a bimetallic switch comes into contact with fluid in the interior chamber above the set point temperature, the bimetallic switch releases the spring so that the plug moves in response to the cold source water pressure, thereby allowing cold water to flow from the outlet port at the cold water source to the valve's outlet port at interior chamber 23. The operation of both mechanical and electronic drain tempering valves is well known and, therefore, a further detailed description of their operation is not provided herein.

Often, commercial warewashing machines are designed such that their hot water tanks 16 are only required to be drained after multiple dishware cleaning cycles, for example six to eight cycles, which facilitates water conservation. Although known drain water tempering systems may function properly when the hot water tank is purposefully being drained, problems are known to exist during repeated cleaning cycles in which standpipe 30 remains in the seated position within drain 17, as shown in FIG. 1A. Specifically, referring additionally to FIG. 2A, during the repeated cleaning cycles of the dishware, small amounts of hot water (indicated by arrows 11) can enter the open top end 34 of standpipe 30 and flow down the standpipe's inner surface into interior chamber 23 of drain water fitting 22. The amount of hot water that passes through standpipe 30, and the rate at which the hot water passes, is typically not great enough to cause the water to accumulate within drain water fitting 22. Rather, the small amounts of hot wastewater drain continuously from drain water fitting 22 into the drainage system. Such hot water accumulation within interior chamber 23 is not great enough to submerge, or even make contact with, temperature sensor 26 of drain tempering valve 24. As a result, drain tempering valve 24 remains in the closed position, and cold water is not mixed with the hot wastewater. The draining wastewater exits drain water fitting 22 at substantially the same temperature as that of the volume of hot water 19 that is stored within hot water tank 16. As noted above, temperatures of up to 180° F. are often utilized during typical cleaning and sanitizing operations, meaning known drain water tempering systems may allow wastewater drainage exceeding the threshold temperature set by regulations to enter the drainage system of the corresponding building.

The present invention recognizes and addresses considerations of prior art constructions and methods.

SUMMARY

An embodiment of the present disclosure provides a warewashing system for dishware with a drain water tempering system including a warewashing machine having a housing defining an internal volume, a heat source for heating water from a first water source, a hot water tank adjacent the internal volume for receiving and collecting the water heated by the heat source, and an agitation unit for applying the water heated by the heat source to the dishware when the dishware is received in the housing, a drain water fitting having a body defining an interior chamber, a drain water inlet port in fluid communication with a drain of the hot water tank, a drain water outlet port, and a cool water inlet port configured to communicate with a cool water source, and a drain tempering valve disposed within the cool water inlet port and movable between a closed position in which the drain water tempering valve blocks a fluid flow path between the cool water source and the interior chamber and an open position in which the drain tempering valve opens the flow path, the drain tempering valve including a thermostatic sensor operative about a set point temperature to control the drain tempering valve to the closed position when the thermostatic sensor senses a temperature below the set point and to control the drain tempering valve to the open position when the thermostatic sensor senses a temperature above the set point, wherein the interior chamber of the drain water fitting defines a top volume portion and a bottom volume portion, the bottom volume portion being disposed below a threshold at which the drain water outlet port intersects the interior chamber of the body, and at least a portion of the temperature sensor of the drain tempering valve is disposed within the bottom volume portion of the interior chamber.

Another embodiment of the present disclosure provides a warewashing system for dishware with a drain water tempering system including a warewashing machine having a housing defining an internal volume, a heat source for heating the water from a first water source, and a hot water tank including a drain, the hot water tank being adjacent the internal volume for receiving and collecting the water heated by the heat source, a drain water fitting having a top end, a bottom end, and a body extending therebetween that defines an interior chamber, a drain water inlet port in fluid communication with the drain of the hot water tank, a drain water outlet port, and a cool water inlet port configured to communicate with a cool water source, and a drain tempering valve disposed within the cool water inlet port and movable between a closed position in which the drain water tempering valve blocks a fluid flow path between the cool water source and the interior chamber and an open position in which the drain tempering valve opens the flow path, the drain tempering valve including a thermostatic sensor operative about a set point temperature to control the drain tempering valve to the closed position when the thermostatic sensor senses a temperature below the set point and to control the drain tempering valve to the open position when the thermostatic sensor senses a temperature above the set point, wherein a longitudinal center axis of the cool water inlet port is disposed between the bottom end of the drain water fitting and a longitudinal center axis of the drain water outlet port.

Yet another embodiment of the present disclosure provides a drain water tempering system for use with a warewashing machine having a housing defining an internal volume, a heat source for heating the water from a first water source, a hot water tank for receiving the water heated by the heat source, and an agitation unit for applying the water dishware disposed in the housing, the drain water tempering system including a drain water fitting having a body defining an interior chamber, a drain water inlet port in fluid communication with a drain of the hot water tank, a drain water outlet port, and a cool water inlet port configured to communicate with a cool water source, and a drain tempering valve disposed within the cool water inlet port and movable between a closed position in which the drain water tempering valve blocks a fluid flow path between the cool water source and the interior chamber and an open position in which the drain tempering valve opens the flow path, the drain tempering valve including a thermostatic sensor operative about a set point temperature to control the drain tempering valve to the closed position when the thermostatic sensor senses a temperature below the set point and to control the drain tempering valve to the open position when the thermostatic sensor senses a temperature above the set point, wherein the interior chamber of the drain water fitting defines a top volume portion and a bottom volume portion, the bottom volume portion being disposed below a threshold at which the drain water outlet port intersects the interior chamber of the body, and at least a portion of the temperature sensor of the drain tempering valve is disposed within the bottom volume portion of the interior chamber.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
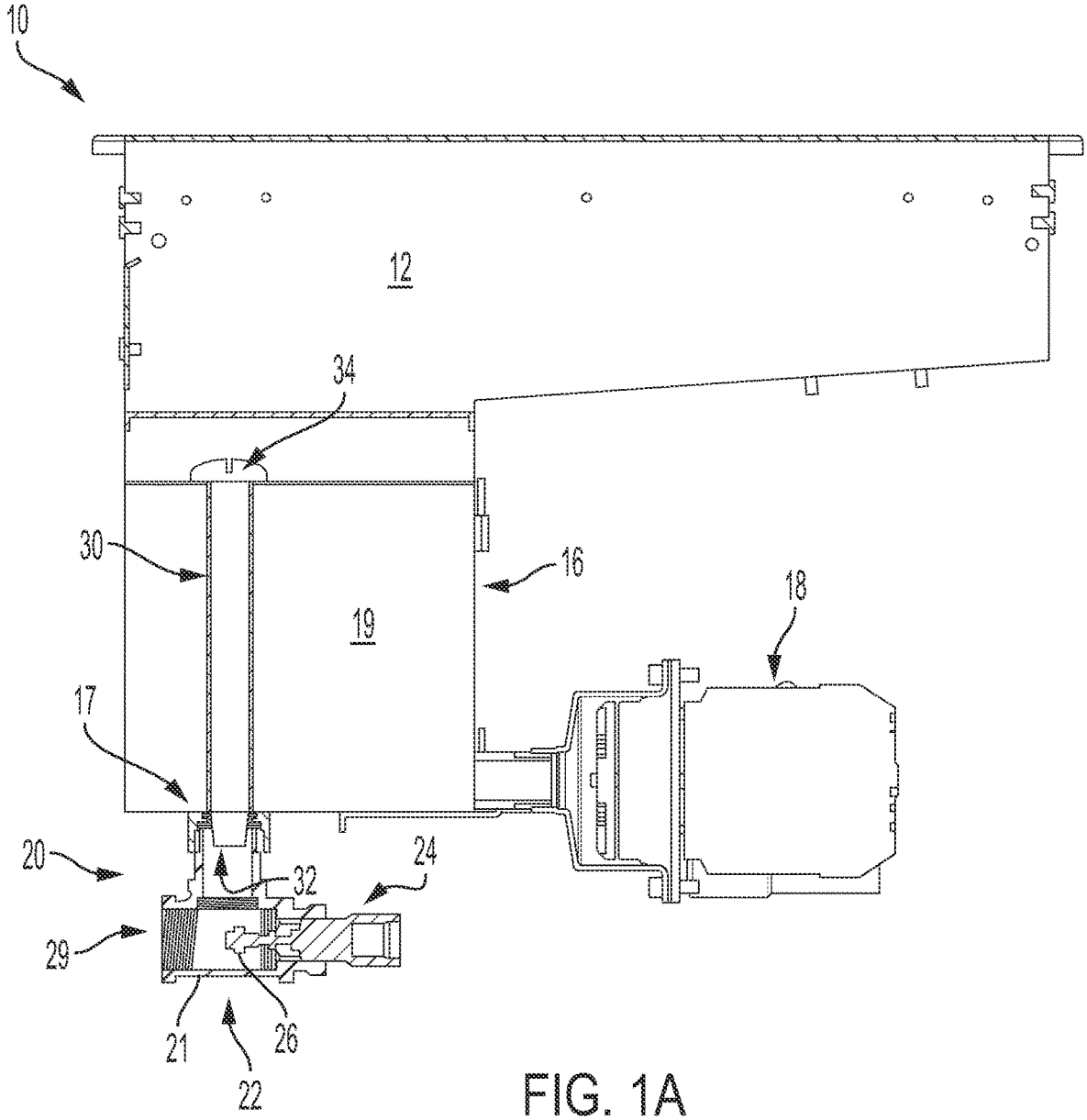
FIG. 1A PRIOR ART
FIGS. 1A and 1B are partial cross-sectional views of a warewashing machine including a prior art drain water tempering system.
Figure 1B:
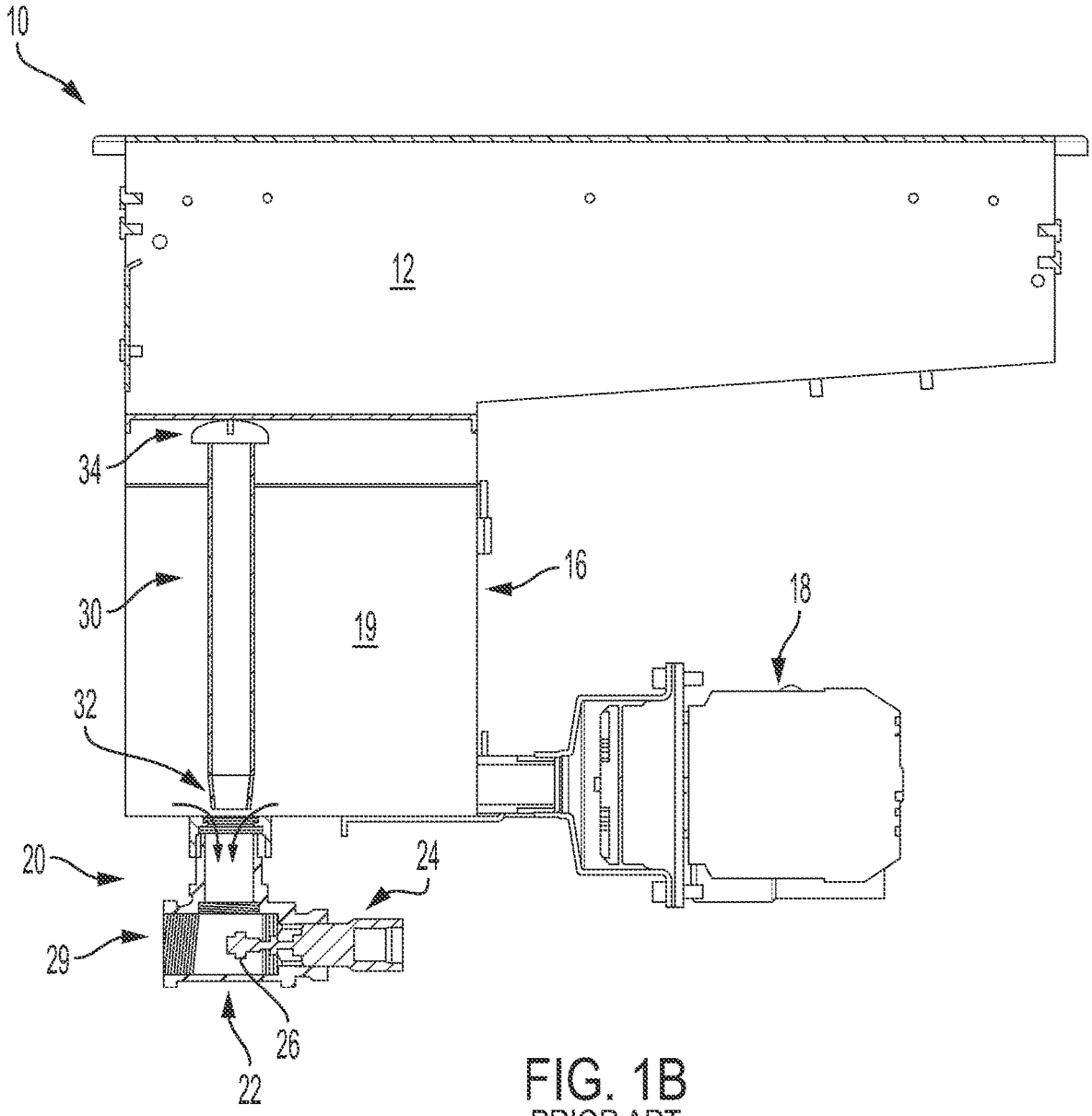
FIG. 1B PRIOR ART

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 3:
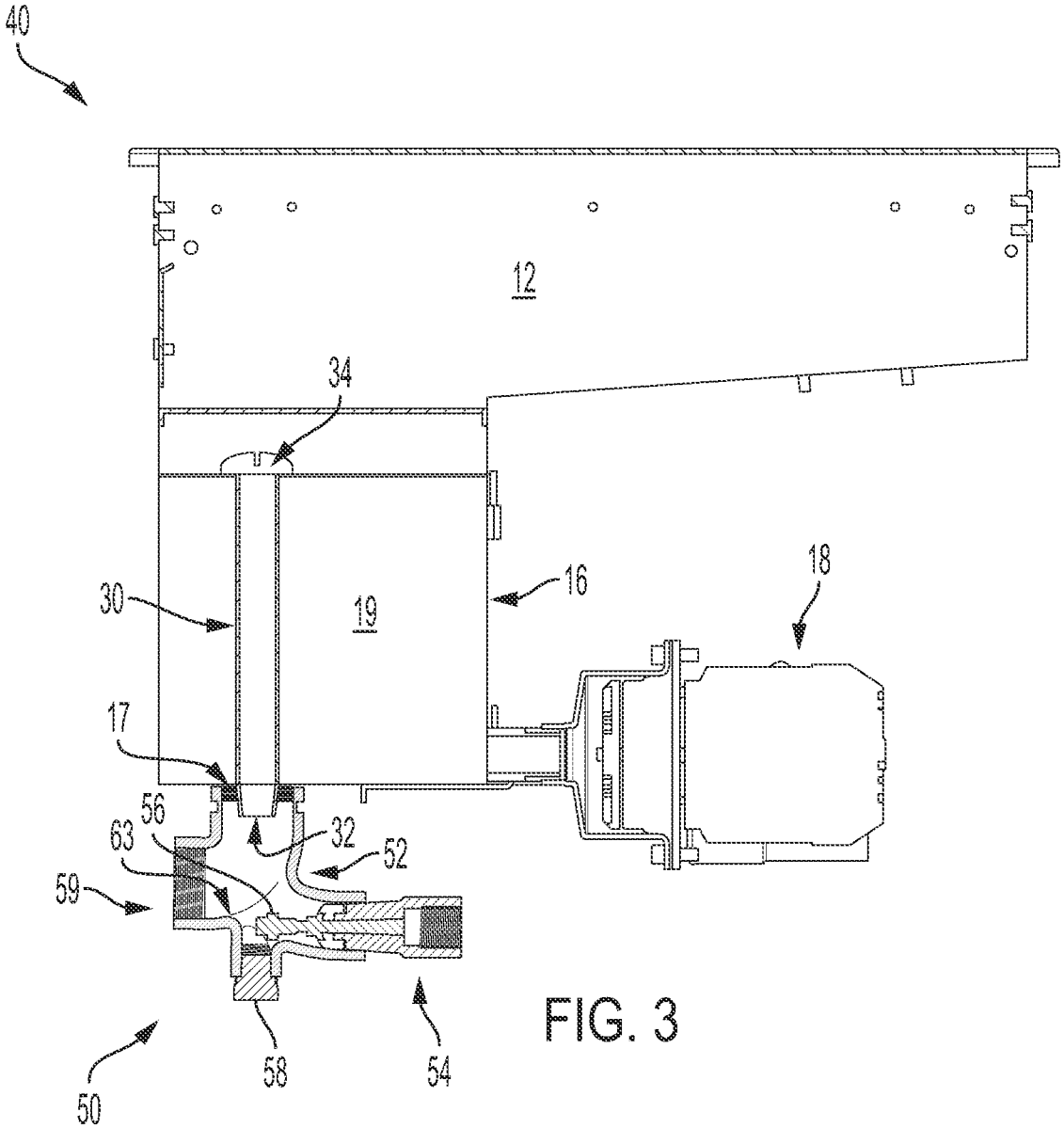
FIG. 3 is a partial cross-sectional view of a warewashing machine including a drain water tempering system in accordance with an embodiment of the present invention.
Figure 4A:
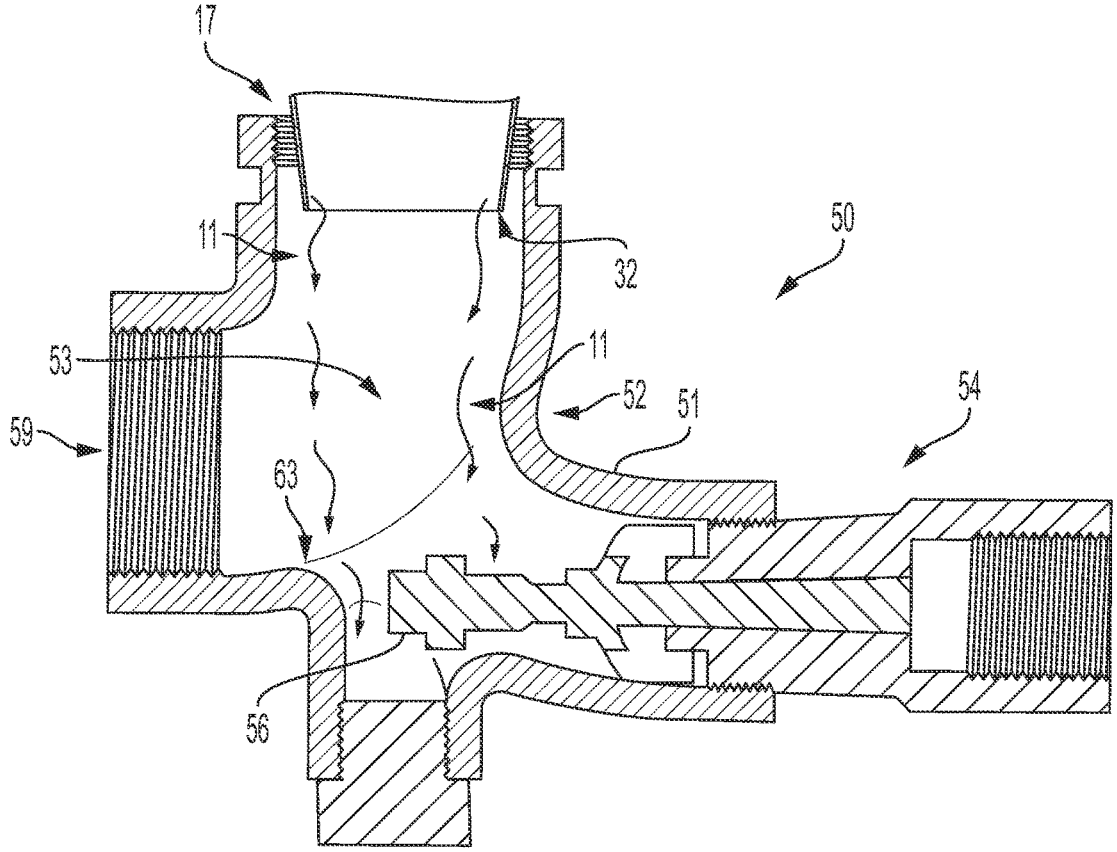
FIGS. 4A and 4B are cross-sectional views of the drain water tempering system shown in FIG. 4.
Figure 4B:
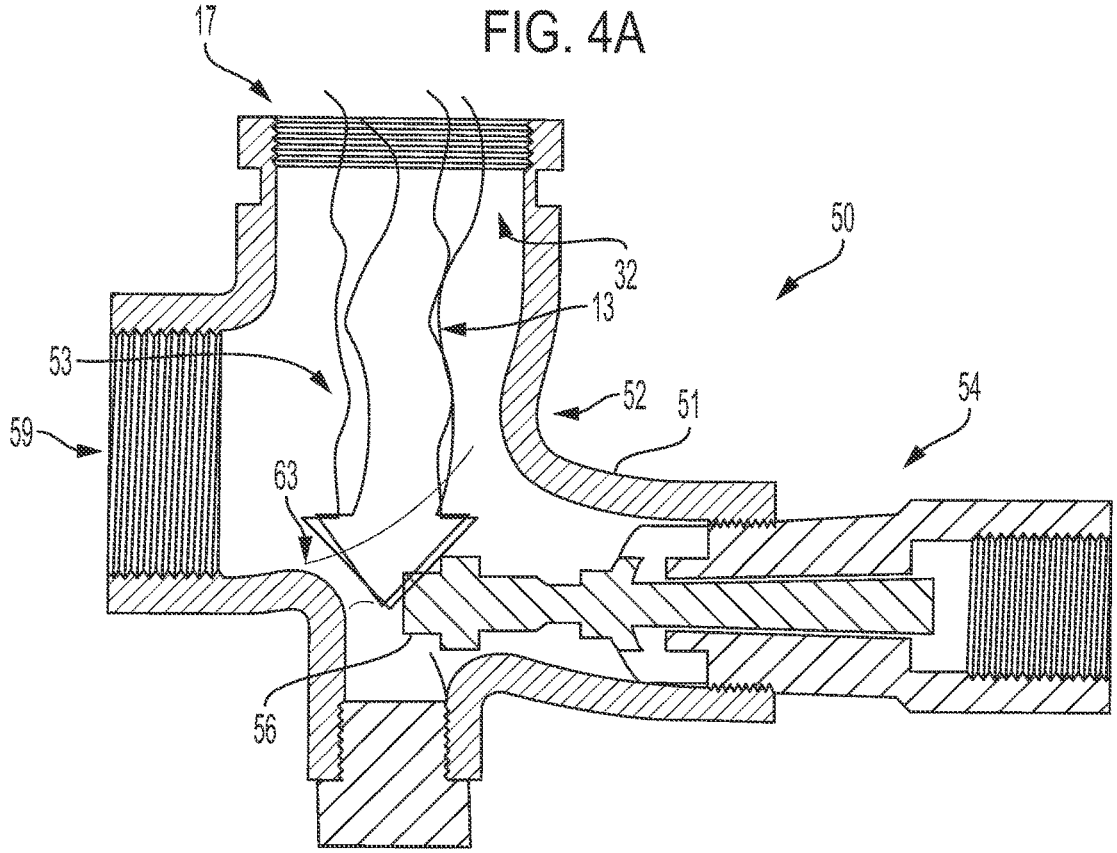

As used herein, terms referring to a direction or a position relative to the orientation of the dishware cooling system for a warewashing machine, such as but not limited to "vertical," "horizontal," "top," "bottom," "above," or "below," refer to directions and relative positions with respect to the dishware cooling system's orientation in its normal intended operation, as indicated in FIGS. 3, 4A, and 4B. Thus, for instance, the terms "vertical" and "top" refer to the vertical orientation and relative upper position in the perspective of FIGS. 3, 4A, and 4B and should be understood in that context, even with respect to a dishware cooling system that may be disposed in a different orientation.

Further, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "and" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "and," and "the" may include plural references, and the meaning of "in" may include "in" and "on." The phrase "in one embodiment," as used herein, does not necessarily refer to the same embodiment, although it may.

Figure 5:
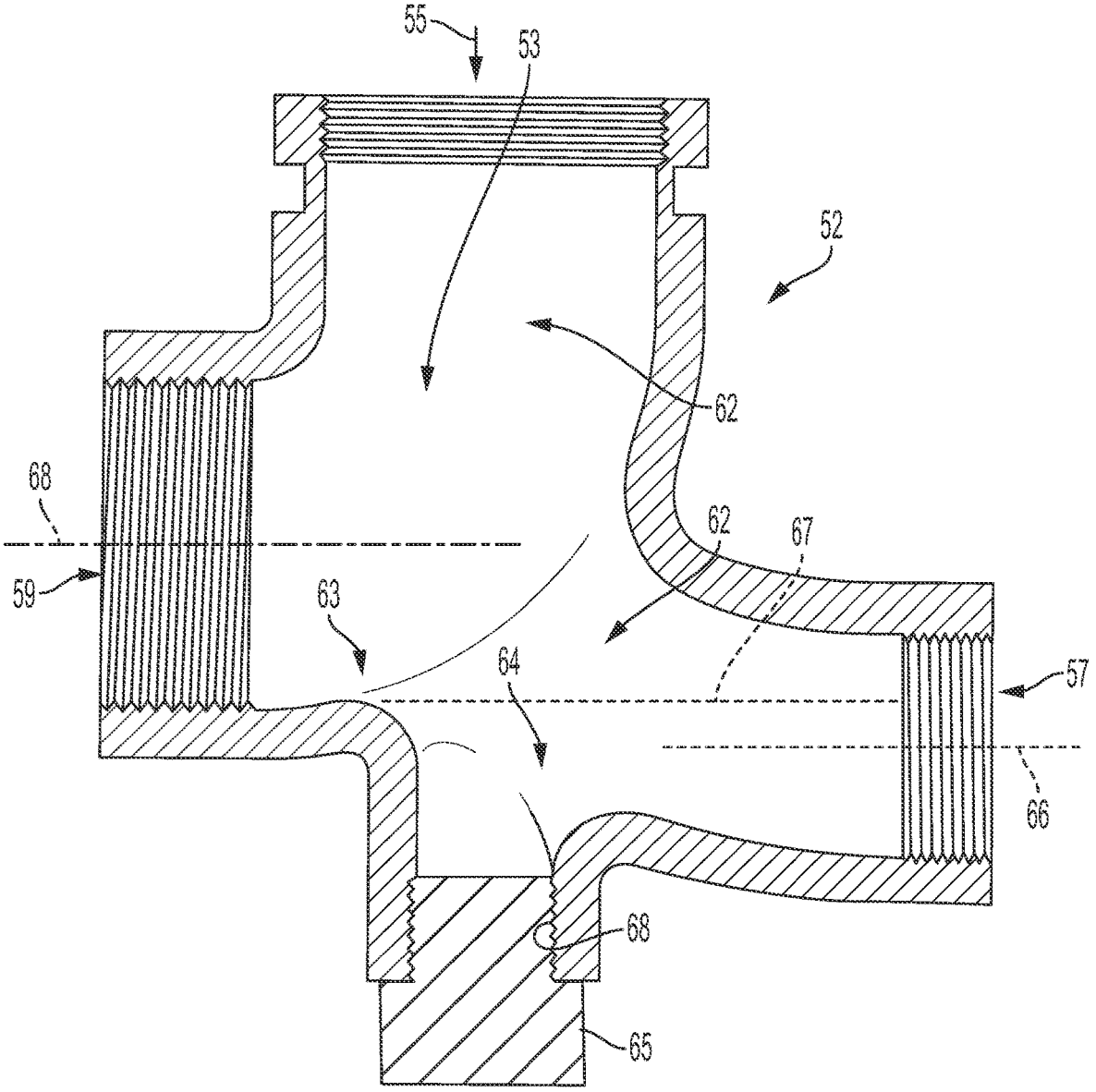
FIG. 5 is a cross-sectional view of a drain water fitting of the drain water tempering system shown in FIGS. 4A and 4B.

Referring now to the figures, specifically FIGS. 3, 4A and 5, a drain water tempering system 50 in accordance with the present disclosure includes a drain water fitting 52 and a drain tempering valve 54. As shown, drain water fitting 52 includes a body 51 defining an interior chamber 53. Body 51 includes a drain water inlet 55 formed at the top end of body 51, a cool water inlet port 57, and a drain water outlet port 59, the cool water inlet port 57 and drain water outlet ports 59 intersecting the side wall of body portion 51. As shown, drain water inlet port 55 is in fluid communication with drain 17 of hot water tank 16 of warewashing machine 40, drain water outlet port 59 is in fluid communication with a drainage system 71 (FIG. 6) of a building, and cool water inlet port 57 is in fluid communication with a cool water source 43 (FIG. 6) by way of drain tempering valve 54, which is disposed therein. A clean out port 68 may be formed in a bottom wall of body portion 51, clean out port 68 being sealed by a selectively removable clean out plug 65 to allow drain water fitting 52 to be selectively drained and cleaned when desired.

Referring specifically to FIG. 5, drain water fitting 52 of drain water tempering system 50 is configured to accumulate small amounts of hot drain water (11, FIG. 4A) that may pass through a standpipe of a warewashing machine during routine cleaning cycles to help insure proper tempering prior to entering the associated drainage system. As shown, body 51 of drain water fitting 52 defines an interior chamber 53 that includes a top volume portion 62 and a bottom volume portion 64. The boundary between top volume portion 62 and bottom volume portion 64 is defined by a horizontal plane 67 that is tangent to a threshold 63 where drain water outlet port 59 intersects interior chamber 53 of drain water fitting 52. As such, drain water passing through standpipe 30 of warewashing machine 40 (FIG. 3) accumulates in bottom volume portion 64 until the level of the accumulated water exceeds the level of threshold 63. As shown, a longitudinal center axis 66 of cool water inlet port 57 is disposed below plane 67 (in which threshold 63 lies). As such, as shown in FIG. 4A, temperature sensor 56 of drain tempering valve 54 is disposed at least partially within bottom volume portion 64 so that draining wastewater makes contact with temperature sensor 56 prior to flowing out of drain tempering valve 54. Also as shown in the illustrated embodiment, a longitudinal center axis 68 of drain water outlet port 59 is disposed above plane 67.

Figure 6:
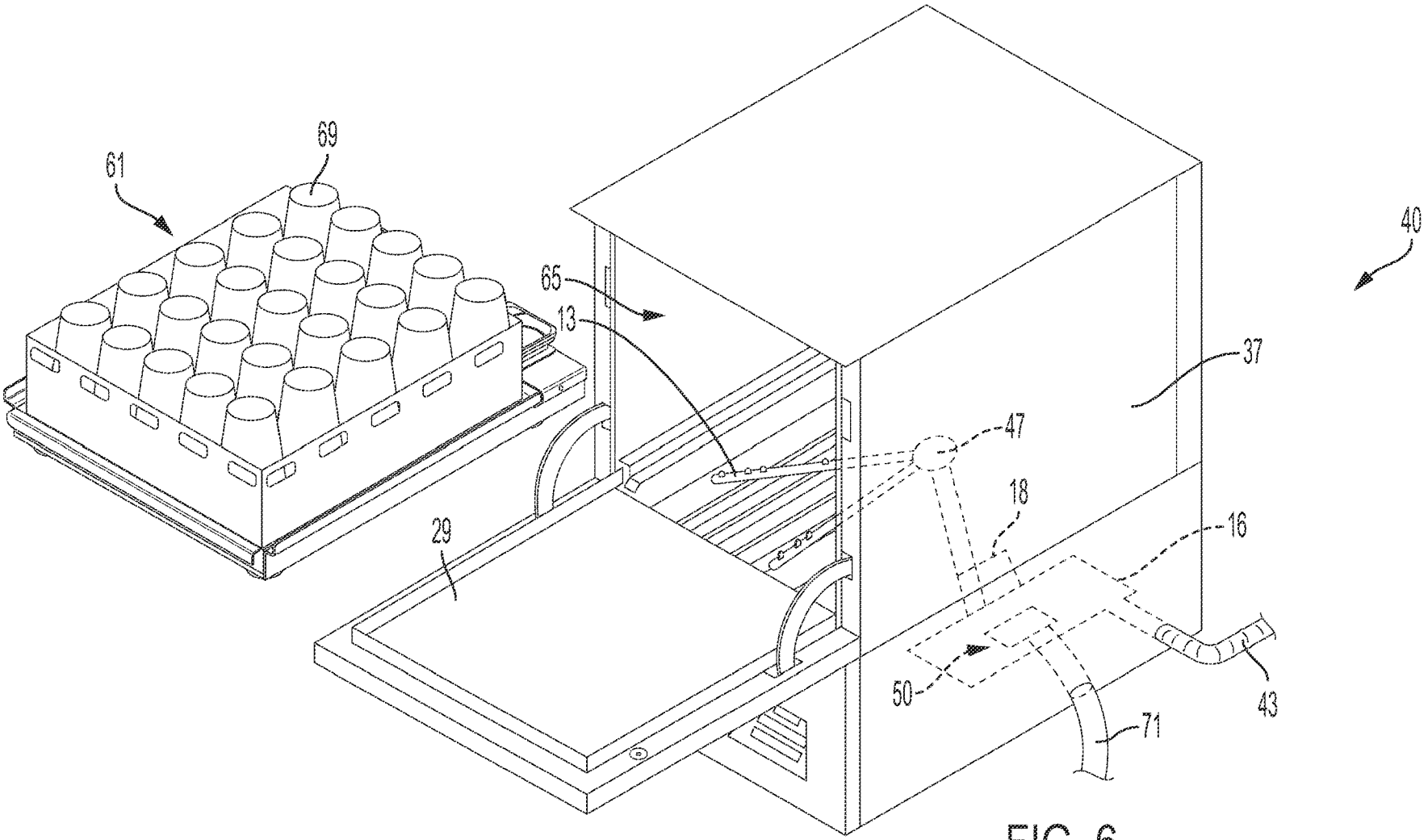
FIG. 6 is a perspective view of a warewashing machine including the drain water tempering system shown in FIGS. 4A and 4B.

Referring additionally to FIG. 6, a warewashing machine 40 including an embodiment of a drain water tempering system 50 is shown. Although a stand-alone warewashing machine 40 is shown in the illustrated example, the disclosed drain water tempering system may be used with pass-through style machines as well. With regard to the illustrated example, an operator initially places a rack 61 with dishware 69 into the interior volume 65 of warewashing machine 40. Warewashing machine 40 has a housing 37 that defines interior volume 27 a front opening thereof, and that includes a door 29. A water source, e.g. a municipal water supply, is indicated by an input water line at 43. A pump (not shown) draws water from water source 43 and drives the water into a hot water tank 16 that includes a heating unit, the hot water tank being disposed in the lower part of housing 37. A recirculation pump 18 forces the heated water up to an agitation unit 47 having a plurality of arms 13 (only two of which are indicated in FIG. 6) that rotate about a vertical axis while spraying pressurized water upward therefrom. Upon the return of door 29 to its upright position and the user's actuation of warewashing machine 40, the machine's control circuitry applies electrical power to the heating unit to heat the incoming water from source 43 at up to approximately 180° F. or another predetermined temperature level, e.g. approximately 160° F. or 165° F., and recirculation pump 18 pumps the heated water to agitation unit 47/13, which sprays the heated water upward through apertures in rotating spray arms 13, thereby cleaning and sanitizing the dishware, as should be understood. Upon completion of the sanitization and cleaning operations on dishware 69, the operator removes rack 61 from the warewashing machine 40 such that another cleaning operation of dishware disposed in another rack may be performed. As previously noted, multiple cleaning operations are preferably performed utilizing substantially the same water that is initially received within hot water tank 16.

Referring specifically to FIGS. 3 and 4A, in operation, a standpipe 30 has an open bottom end 32 that is seated within drain 17 of hot water tank 16 so that hot water accumulates within the hot water tank 16 until the level of hot water 19 reaches an open top end 34 of the standpipe 30. Preferably, the volume of hot water 19 within hot water tank 16 is utilized for multiple cleaning cycles of multiple sets of dishware, for example, up to six to eight cleaning cycles, before the hot water is drained. As shown in FIGS. 4B, the used wastewater is drained from hot water tank 16 by moving standpipe 30 in an upward direction, such as by a lever or handle (not shown), thereby unseating open bottom end 32 of standpipe 30 from drain 17 of hot water tank 16. As such, the wastewater disposed within hot water tank 16 is now free to drain into interior chamber 53 of drain water fitting 52.

Drain tempering valve 54 includes a thermostatic sensor 56 that extends inwardly into interior chamber 53 of the drain water fitting. In the illustrated embodiment, drain tempering valve 54 is a mechanical valve including a bimetallic switch (not shown). Drain tempering valve 54 includes a bimetallic switch that is operable about the desired threshold temperature, such as 160° F., so that when thermostatic sensor 56 is immersed in draining wastewater (indicated by arrow 13) that exceeds the set point, as shown in FIG. 4B, the bimetallic switch changes state, thereby causing drain tempering valve 54 to open so that cold water flows into interior chamber 53 of drain water fitting 52. As such, the cold water is mixed with the draining wastewater prior to the wastewater exiting drain water outlet port 25. As long as the temperature of the wastewater within interior chamber 53 of drain water fitting 52 exceeds the set point, the bimetallic switch will maintain drain tempering valve 54 in the open position. Once the temperature of the wastewater with interior chamber 53 no longer exceeds the set point, the bimetallic switch changes state, thereby closing the drain tempering valve 54 and securing, or stopping, the flow of cold water into the drain water fitting 52. Electronic drain tempering valves may also be used in the currently disclosed drain water tempering systems. The operation of both mechanical and electronic drain tempering valves is well known and, therefore, a detailed description of their operation is not provided herein.

Figure 2A:
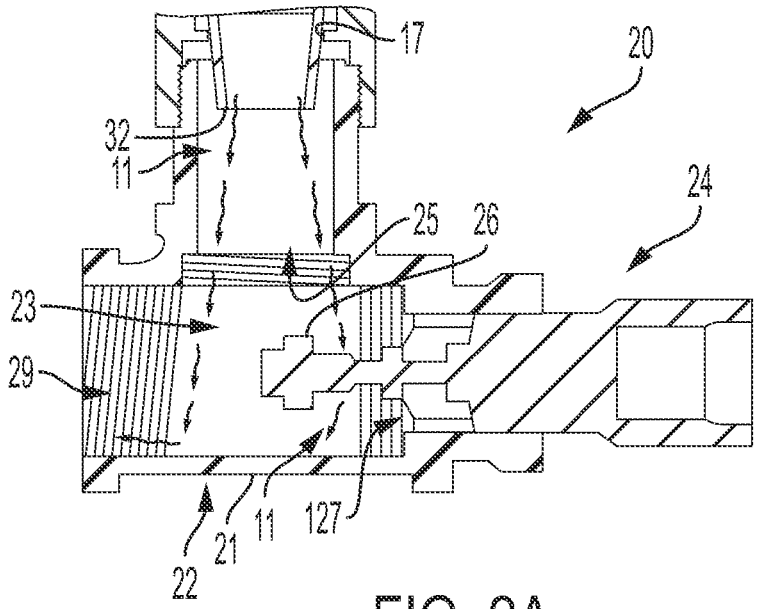
FIG. 2A PRIOR ART
FIGS. 2A and 2B are partial cross-sectional views of the warewashing machine and drain water tempering system shown in FIGS. 1A and 1B.
Figure 2B:
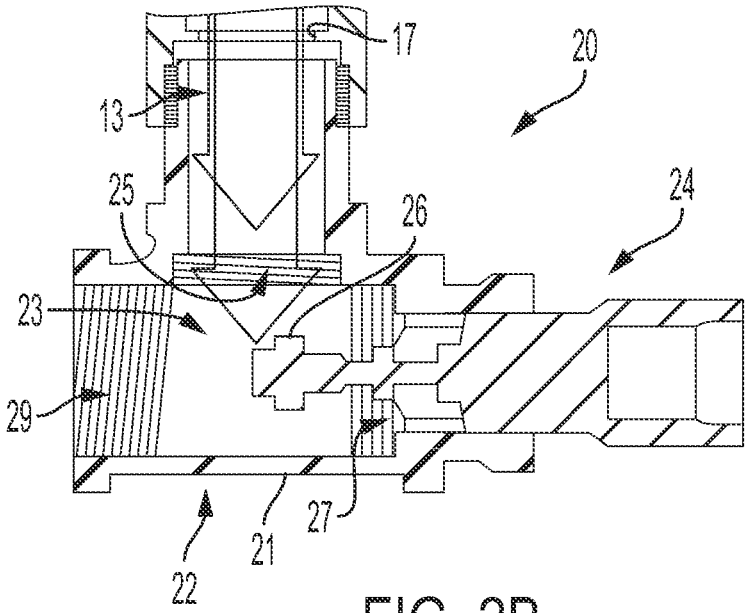
FIG. 2B PRIOR ART

As previously discussed, commercial warewashing machines are often designed so that their hot water tanks 16 are only drained after multiple dishware cleaning cycles, for example six to eight cycles. Referring specifically to FIGS. 4A and 5, during the repeated cleaning cycles of the dishware, small amounts of hot water (indicated by arrows 11) may enter the open top end 34 of standpipe 30 and flow down the inner surface of standpipe 30 into interior chamber 53 of drain water fitting 52. Unlike the previously discussed prior art drain water tempering systems, such as that discussed previously with regard to FIGS. 2A and 2B, in which small amounts of hot water (indicated by arrows 11) drain continuously from the drain water fitting into the drainage system, small amounts of hot water 11 passing through standpipe 30 during normal cleaning cycles accumulate within interior chamber 53 of the presently disclosed drain water fitting 52. As such, embodiments of the disclosed drain water tempering system 50 allow for tempering small flows of hot water that drain through standpipe 30 during normal cleaning cycles, as discussed in greater detail below.

Specifically, referring to FIGS. 3, 4A and 5, during normal dishware cleaning cycles, small amounts of hot water 11 that enter open top end 34 of standpipe 30 accumulate within bottom volume portion 64 of drain water fitting 52 until the top surface of the accumulated hot water reaches the level of threshold 63, which is the bottommost surface of the intersection of cool water outlet port 59 and interior chamber 53 of drain water fitting 52. As shown, at least a portion of thermostatic sensor 56 of drain tempering valve 54 is disposed within bottom volume portion 64 below threshold 63, meaning thermostatic sensor 56 is at least partially submerged within the hot water accumulated in bottom volume portion 64. As such, thermostatic sensor 56 is operable to detect and respond to the temperature of the accumulated hot water within bottom volume portion 64 to thereby actuate the bimetallic switch of drain tempering valve 54 when the accumulated hot water exceeds the pre-selected temperature. As such, adequate tempering of hot drain water is accomplished whether hot water thank 16 is being fully drained by the removal of standpipe 30 from drain 17 (FIG. 4B), or small amounts of hot water are entering drain water tempering system 50 during repeated cleaning cycles (FIG. 4A).

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

The invention claimed is:

1. A warewashing system for dishware with a drain water tempering system, comprising:

a warewashing machine having a housing defining an internal volume, a hot water tank adjacent the internal volume, and an agitation unit;

a drain water fitting having a body defining an interior chamber, a drain water inlet port in fluid communication with a drain of the hot water tank, a drain water outlet port, and a cool water inlet port; and a drain tempering valve coupled with the cool water inlet port and movable between a closed position in which the drain water tempering valve blocks a fluid flow path into the interior chamber and an open position in which the drain tempering valve opens the fluid flow path, the drain tempering valve including a thermostatic sensor operative about a set point temperature to control the drain tempering valve to the closed position when the thermostatic sensor senses a temperature below the set point and to control the drain tempering valve to the open position when the thermostatic sensor senses a temperature above the set point;

wherein the interior chamber of the drain water fitting defines a top volume portion and a bottom volume portion, the bottom volume portion being disposed below a threshold at which the drain water outlet port intersects the interior chamber of the body, and at least a portion of the thermostatic sensor of the drain tempering valve is disposed within the bottom volume portion of the interior chamber.

2. The warewashing system of claim 1, wherein a longitudinal center axis of the cool water inlet port extends into the bottom volume portion of the interior chamber of the drain water fitting.

3. The warewashing system of claim 1, wherein a longitudinal center axis of the cool water inlet port is disposed between a bottom end of the drain water fitting and a longitudinal center axis of the drain water outlet port.

4. The warewashing system of claim 1, wherein the thermostatic sensor of the drain tempering valve is disposed entirely within the bottom volume portion of the interior chamber.

5. The warewashing system of claim 1, further comprising a standpipe having a top end, a bottom end, and an elongated body extending therebetween, wherein the bottom end of the standpipe is removably seated within the drain of the hot water tank.

6. The warewashing system of claim 1, wherein the drain tempering valve is one of a mechanically-controlled valve having a bimetallic switch and an electronically-controlled valve having a solenoid.

7. The warewashing system of claim 1, wherein a cool water source is in fluid communication with the cool water inlet port of the drain tempering valve.

8. A warewashing system for dishware with a drain water tempering system, comprising:

a warewashing machine having a housing defining an internal volume and a hot water tank including a drain, the hot water tank being adjacent the internal volume;

a drain water fitting having a top end, a bottom end, and a body extending therebetween that defines an interior chamber, a drain water inlet port in fluid communication with the drain of the hot water tank, a drain water outlet port, and a cool water inlet port; and a drain tempering valve coupled with the cool water inlet port and movable between a closed position in which the drain water tempering valve blocks a fluid flow path into the interior chamber and an open position in which the drain tempering valve opens the fluid flow path, the drain tempering valve including a thermostatic sensor operative about a set point temperature to control the drain tempering valve to the closed position when the thermostatic sensor senses a temperature below the set point and to control the drain tempering valve to the open position when the thermostatic sensor senses a temperature above the set point;

wherein a longitudinal center axis of the cool water inlet port is disposed between the bottom end of the drain water fitting and a longitudinal center axis of the drain water outlet port.

9. The warewashing system of claim 8, wherein the longitudinal center axis of the cool water inlet port is parallel to the longitudinal center axis of the drain water outlet port.

10. The warewashing system of claim 8, wherein the interior chamber of the drain water fitting defines a top volume portion and a bottom volume portion, the bottom volume portion being disposed below a threshold at which the drain water outlet port intersects the interior chamber of the body of the drain water fitting, and at least a portion of the thermostatic sensor of the drain tempering valve is disposed within the bottom volume portion of the interior chamber.

11. The warewashing system of claim 8, further comprising an agitation unit.

12. A drain water tempering system for use with a warewashing machine having a housing defining an internal volume, a hot water tank, and an agitation unit, the drain water tempering system comprising:

a drain water fitting having a body defining an interior chamber, a drain water inlet port in fluid communication with a drain of the hot water tank, a drain water outlet port, and a cool water inlet port; and a drain tempering valve coupled with the cool water inlet port and movable between a closed position in which the drain water tempering valve blocks a fluid flow path into the interior chamber and an open position in which the drain tempering valve opens the fluid flow path, the drain tempering valve including a thermostatic sensor operative about a set point temperature to control the drain tempering valve to the closed position when the thermostatic sensor senses a temperature below the set point and to control the drain tempering valve to the open position when the thermostatic sensor senses a temperature above the set point;

wherein the interior chamber of the drain water fitting defines a top volume portion and a bottom volume portion, the bottom volume portion being disposed below a threshold at which the drain water outlet port intersects the interior chamber of the body, and at least a portion of the thermostatic sensor of the drain tempering valve is disposed within the bottom volume portion of the interior chamber.

13. The drain water tempering system of claim 12, wherein a longitudinal center axis of the cool water inlet port extends into the bottom volume portion of the interior chamber of the drain water fitting.

14. The drain water tempering system of claim 12, wherein a longitudinal center axis of the cool water inlet port is disposed between a bottom end of the drain water fitting and a longitudinal center axis of the drain water outlet port.

15. The drain water tempering system of claim 12, wherein the thermostatic sensor of the drain tempering valve is disposed entirely within the bottom volume portion of the interior chamber.

16. The drain water tempering system of claim 12, further comprising a standpipe having a top end, a bottom end, and an elongated body extending therebetween, wherein the bottom end of the standpipe is removably seated within the drain of the hot water tank.

17. The drain water tempering system of claim 12, wherein the drain tempering valve is one of a mechanically-controlled valve having a bimetallic switch and an electronically-controlled valve having a solenoid.

* * * * *